US008916243B2

(12) United States Patent
Fu et al.

(10) Patent No.: US 8,916,243 B2
(45) Date of Patent: Dec. 23, 2014

(54) GRAPHIC MEDIUM AND METHOD OF MAKING SAME

(75) Inventors: Xulong Fu, San Diego, CA (US); Lokendra Pal, San Diego, CA (US); Ronald J Selensky, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/982,259

(22) PCT Filed: Jan. 31, 2011

(86) PCT No.: PCT/US2011/023201

§ 371 (c)(1), (2), (4) Date: Jul. 27, 2013

(87) PCT Pub. No.: WO2012/105939

PCT Pub. Date: Aug. 9, 2012

(65) Prior Publication Data

US 2013/0306259 A1 Nov. 21, 2013

(51) Int. Cl.

| | |
|---|---|
| ***D21H 19/00*** | (2006.01) |
| ***D21H 19/84*** | (2006.01) |
| ***B41M 5/50*** | (2006.01) |
| ***B41M 5/52*** | (2006.01) |
| *B41M 5/44* | (2006.01) |

(52) U.S. Cl.

CPC ..... *D21H 19/84* (2013.01); *B41M 5/508* (2013.01); *B41M 5/52* (2013.01); *B41M 5/44* (2013.01); *B41M 5/506* (2013.01); *B41M 5/5218* (2013.01); *B41M 5/5236* (2013.01); *B41M 5/5254* (2013.01); *B41M 2205/02* (2013.01); *B41M 2205/06* (2013.01); *B41M 2205/34* (2013.01); *B41M 2205/36* (2013.01)

USPC ..... 428/32.18; 162/175; 162/164.7; 162/137; 428/32.19

(58) Field of Classification Search

CPC ..... D21H 19/00; D21H 19/80; D21H 19/84; D21H 19/826; D21H 19/828; B41M 5/00; B41M 5/50

USPC ..... 162/137, 175, 164.7; 428/31.1, 32.18, 428/32.19

See application file for complete search history.

(56) References Cited

U.S. PATENT DOCUMENTS 5,180,624 A 1/1993 Kojima et al.
5,843,566 A 12/1998 Miyauchi et al.

(Continued)

FOREIGN PATENT DOCUMENTS

CN 1938154 A 3/2007
CN 101068983 A 11/2007

(Continued)

OTHER PUBLICATIONS

International Search Report (ISR) of the International Searching Authority (ISA/KR) for counterpart PCT Application No. PCT/US2011/023201, dated Oct. 27, 2011, 3 pages.

Nogi, M. et al., Optically Transparent Nanofiber Paper, Adv. Mater., 2009, 1595-1598, 21, Wiley-VCH Verlag GmbH & Co., Weinheim.

(Continued)

*Primary Examiner* — Jacob Thomas Minskey

(74) *Attorney, Agent, or Firm* — North Shore Associates; Elizabeth E. Leitereg

(57) ABSTRACT

A graphic medium and a method of making same employs a paper core having a normalized opacity within a range of about 0.15 to about 0.4 percent/grams per square meter. The graphic medium includes a first material layer on a first side of the paper core and a second material layer on one or both of the first side between the paper core and the first material layer and a second, opposite side of the paper core. The graphic medium has a translucent opacity between about 40% and about 90%. The method includes mechanically refining a mixture of wood fibers until a paper substrate is formed having the normalized opacity. The paper substrate is calendered using a paper making machine and the first and second material layers are applied to form the graphic medium.

20 Claims, 3 Drawing Sheets

(56) References Cited

U.S. PATENT DOCUMENTS

| | | | | |
|---|---|---|---|---|
| 6,294,243 | B1 | 9/2001 | Nakamura | |
| 6,468,641 | B2 | 10/2002 | Rakos et al. | |
| 7,182,455 | B2 | 2/2007 | Sebastian et al. | |
| 2004/0185193 | A1 * | 9/2004 | Taka et al. | 428/32.18 |
| 2005/0084699 | A1 | 4/2005 | Depres | |
| 2006/0115633 | A1 | 6/2006 | Steichen et al. | |
| 2007/0031658 | A1 | 2/2007 | Rummel et al. | |
| 2007/0110925 | A1 | 5/2007 | Ridless | |
| 2008/0248318 | A1 * | 10/2008 | Fry et al. | 428/454 |
| 2009/0035478 | A1 | 2/2009 | Zhou et al. | |
| 2009/0162580 | A1 | 6/2009 | Dontula et al. | |

FOREIGN PATENT DOCUMENTS

| | | | |
|---|---|---|---|
| CN | 101772422 | A | 7/2010 |
| EP | 0695973 | A1 | 2/1996 |
| JP | 10-217602 | A | 8/1998 |
| JP | 11138977 | A | 5/1999 |
| JP | 2008-115504 | A | 5/2008 |

OTHER PUBLICATIONS

Office Action and Search Report dated Jun. 5, 2014 (10 pages) from State Intellectual Property Office (IPO) of the Peoples Republic of China (PRC) for counterpart CN patent application No. 201180066438.4.

* cited by examiner

GRAPHIC MEDIUM AND METHOD OF MAKING SAME

CROSS-REFERENCE TO RELATED APPLICATIONS

N/A

STATEMENT REGARDING FEDERALLY SPONSORED RESEARCH OR DEVELOPMENT

N/A

BACKGROUND

The present disclosure relates to graphic media for backlit or frontlit signage and a method of manufacturing graphic media.

Graphic media used in one or both of backlit and frontlit signage applications characteristically include a sheet of core material that is optically transparent and relatively thin. Common core materials include transparent plastics, such as polyethylene terephthalate (PET) or one or more other polyester resins. The core material sheet typically has one or more coatings formed on one side to support an image and may include one or more coatings on an opposite side to provide light diffusion properties and mechanical properties, for example. The graphic media receive an image, for example formed from ink or toner, which is displayable by back or front illumination. Moreover, graphic media endure a variety of environmental conditions for indoor and outdoor signage applications. However, graphic media are frequently replaced for a variety of reasons, for example, due to sign durability and changes in sign content, to name a few.

The use of plastics for the core material of the graphic media is expensive and not environmentally friendly since plastics are petrochemical based materials that are costly to make and are neither renewable nor readily recyclable when disposed.

BRIEF DESCRIPTION OF THE DRAWINGS

The drawings provided herein are not to scale and are provided for the purpose of facilitating the understanding of certain examples in accordance with the principles described herein and are provided by way of illustration and not limitation on the scope of the appended claims.

DETAILED DESCRIPTION

Figure 1A:
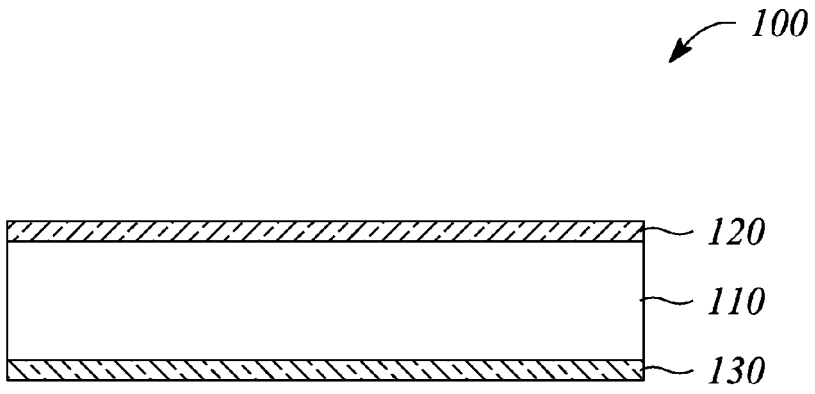
FIGS. 1A and 1B illustrate side views of graphic media according to examples in accordance with the principles described herein.

Some examples in accordance with the principles described herein are directed to a graphic medium that includes a paper core, a first material layer on a first side of the paper core, and a second material layer on one or both of a second side of the paper core that is opposite to the first side and the first side between the paper core and the first material layer. The paper core of the graphic medium is relatively optically transparent, i.e., translucent, in that the paper core has a normalized opacity within a range of about 0.15 and about 0.4 TAPPI opacity in percent (%) per basis weight in grams per square meter (gsm). The graphic medium is optically translucent and finds use in illuminated display or poster applications, such as backlit or frontlit signage for indoor or outdoor applications, for example.

In particular, the opacity of the paper core is much more transparent than most paper at a given basis weight. In some examples, the paper core has an opacity within a range of about 20% to about 70% by TAPPI test method T425, for example, for a basis weight within a range of about 100 gsm to about 300 gsm, for example. One or both of the first material layer and the second material layer on the paper core has a relatively much lower basis weight, for example at least about ten times lower than the basis weight of the paper core. As such, the first material layer and the second material layer may have a negligible impact on the translucent opacity of the graphic medium. For example, the graphic medium has a translucent opacity within a range of 40% and about 90% per TAPPI test method T425.

The first material layer comprises an image receiving material and is also referred to herein as 'an image receiving layer'. The image receiving layer is configured to receive and retain an imaging material, for example an ink or a toner, that is applied to a surface of the image receiving layer in a pattern or an image. The image is displayable on the graphic medium, for example when the graphic medium is illuminated as in the frontlit or backlit display application. The image receiving layer has one or both of good affinity and good compatibility for the imaging material that is applied to the image receiving layer surface.

In some examples, the second material layer provides one or more of opacity control to the graphic medium, curl control (i.e., one or both of flatness and stiffness) to the graphic medium, and protection of the graphic medium from various environmental conditions. In some examples, the second material layer is a coating on the second side of the paper core. The coating is also referred to herein as a 'back coating' for being on the opposite side to the image receiving layer. Moreover, the back coating may be referred to further as a curl control layer in some examples and as an opacity control layer in other examples due to the coating's ability to facilitate control of one or both of curl and opacity, respectively. In some examples, the second material layer is a barrier film that is on one or both of the first side and the second side of the paper core. The barrier films encapsulate and protect the paper core from water penetration, for example, and may give the graphic medium a smooth, glossy appearance. On the first side, the barrier film is between the paper core and the image receiving layer. As such, the barrier film may also facilitate one or both of compatibility between the paper core and the image receiving layer and adhesion therebetween, for example. On the second side, the barrier film facilitates protection of the graphic medium from various environmental conditions and curl control for example.

Moreover, some examples in accordance with the principles described herein are directed to a method of manufacturing a graphic medium with a paper core, for example, the graphic medium described herein. The method includes mixing together wood fibers and mechanically refining the wood fiber mixture to flatten the fibers, remove fluid and air pockets and form a dense fiber mass that is further processed into a paper substrate using a paper making machine, for example. The resultant paper substrate is relatively optically transparent, or translucent, with an opacity of less than about 70% per TAPPI test method T425 at a basis weight of equal to or less than about 300 gsm, for example. The method of manufacturing further includes calendaring the paper substrate to achieve a desired surface smoothness and gloss, for example, and applying a first material layer (i.e., an image receiving layer) and applying a second material layer to the paper substrate using various application techniques, for example. The image receiving layer is applied to a first side of the paper substrate and the second material layer is applied to one or both of a second side of the paper substrate and the first side between the paper core and the image receiving layer to form the graphic medium with a paper core. An opacity of the graphic medium made by the method is within a range of about 40% to about 90% per TAPPI test method T425.

The relative optical transparency of the paper core of the graphic medium at a particular basis weight or thickness, according to the principles described herein, is much higher or greater than the optical transparency of other paper products and other frontlit or backlit graphic media that uses a paper base. This is so because the paper substrate or core contains pure wood cellulosic fibers that are highly refined and calendered using the mechanical process described herein. The extent of mechanical refining and calendering modifies the fiber structure of the paper core, which in turn, controls optical transparency or the opacity and density, for example at a given basis weight of the paper core. In some examples, a normalized opacity of the paper core ranges from about 0.15 to about 0.4 TAPPI opacity (%)/Basis weight (gsm). In contrast, the base paper of other translucent graphic media is significantly thinner (i.e., much less basis weight) than the paper core examples described herein to achieve a similar opacity thereto, such that these other graphic media are subject to limited durability and limited applications, for example.

In other words, the basis weight or thickness of the paper core of the graphic medium, according to the principles described herein, is much higher or greater than other graphic media that use a paper core, but the graphic medium examples herein still achieve a greater relative optical transparency than achieved for other translucent paper-based graphic media. When the paper core is thicker at a given relatively transparent opacity, the graphic medium is more durable for a variety of applications than other paper-based graphic media.

The graphic medium examples in accordance with the principles described herein may demonstrate one or more of the following characteristics: recyclability, renewability, wide ranges of translucent opacity, and sufficient stiffness, for example, for a broad range of signage applications. Compared to graphic media having plastic or polyester-based cores, or even paper-based cores, the graphic medium examples herein exhibit one or more qualities of better durability, better handlability, better manufacturability, more environmentally friendly, and lower cost.

As used herein, the article 'a' is intended to have its ordinary meaning in the patent arts, namely 'one or more'. For example, 'a material' generally means one or more materials and as such, 'the material' means 'the material(s)' herein. The phrase 'at least' as used herein means that the number may be equal to or greater than the number recited. The term 'about' as used herein means that the number recited may differ by plus or minus 10%, for example, 'about 5' means a range of 4.5 to 5.5. The term 'between' when used in conjunction with two numbers such as, for example, 'between about 2 and about 50' includes both of the numbers recited. Any ranges of values provided herein include values within or between the provided ranges. The term 'substantially' as used herein means a majority, or almost all, or all, or an amount with a range of about 51% to 100%, for example. Also, any reference herein to 'top', 'bottom', 'upper', 'lower', 'up', 'down', 'back', 'front', 'left' or 'right' is not intended to be a limitation herein. The designations 'first' and 'second' are used herein for the purpose of distinguishing between items, such as 'first side' and 'second side', and are not intended to imply any sequence, order or importance to one item over another item or any order of operation, unless otherwise indicated. Moreover, examples herein are intended to be illustrative only and are presented for discussion purposes and not by way of limitation.

Further as used herein, opacity values are provided per TAPPI test method T425—Opacity of paper (15/d geometry, illuminant A/2°, 89% reflectance backing and paper backing) and are presented in percent (%) for simplicity of discussion only with the understanding that the opacity (or 'TAPPI opacity') is a value in percent (%) per TAPPI test method T425. The normalized opacity is defined as the opacity in percent by TAPPI method T425 divided by the basis weight in grams per square meter (gsm) and is provided herein in '%/gsm' for simplicity of discussion.

Figure 1B:
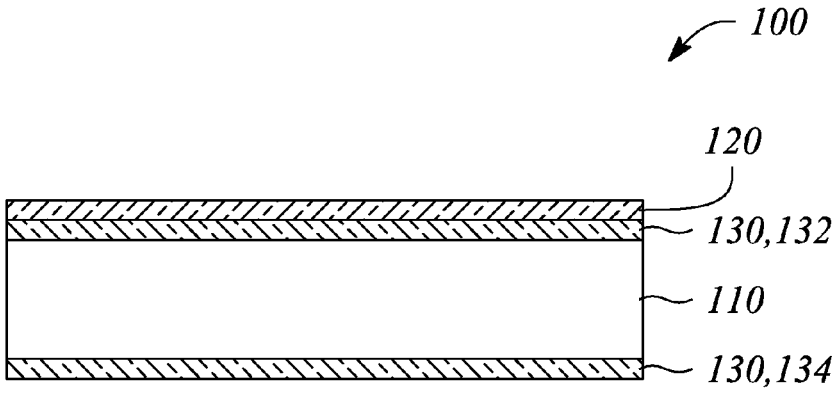

FIGS. 1A and 1B illustrate side views of examples of graphic media according to the principles described herein. FIG. 1A illustrates a graphic medium (100) comprising a paper core (110), an image receiving layer (120) on a first side of the paper core (110) and a coating (130) on a second side of the paper core (110) that is opposite to the first side where the image receiving layer (120) is located.

The paper core (110) in accordance with the principles described herein may be made of any suitable pulp or pulp mixtures of wood-based cellulose fibers. Examples of suitable wood-based fiber pulp include, but are not limited to, bleached softwood kraft pulps, bleached softwood sulfite pulps, and bleached hardwood pulps. In some examples, a small amount (less than 10%) of bleached mechanical pulp, such as Bleached Chemi-Thermo-Mechanical (BCTMP) pulp, may be added to adjust opacity. Bleached pulp is used to avoid possible brownish tint typically found in unbleached pulp. Moreover, fibers from hardwood pulps have a shorter fiber structure and reduced strength with refining than softwood fibers. Therefore, in some examples, the fiber mixture of the paper core (110) comprises substantially more softwood pulp than hardwood pulp.

In some examples, the paper core (110) comprises bleached softwood fiber in an amount by dry weight within a range of about 60 percent (%) to about 100% of the paper core composition. In some examples, the amount by dry weight of bleached softwood fiber in the paper core (110) is within the range of about 65% to 100%, or about 70% to about 100%, or about 75% to about 100%, or about 80% to about 100%, or about 85% to about 100%, or about 90% to about 100%, or about 95% to about 100%, or about 98% to about 100%. Examples of softwood pulp that may be used include, but are not limited to, Northern pine and Southern pine from North America and Birch from Scandinavia.

In some examples, the paper core (110) may further comprise bleached hardwood fiber in an amount by dry weight ranging from about 0% to about 40% of the paper core composition. In some examples, the amount by weight of bleached hardwood fiber in the paper core (110) ranges from about 0% to about 35%, or about 0% to about 30%, or about 0% to about 25%, or about 0% to about 20%, or about 0% to about 15%, or about 0% to about 10%, or about 0% to about 5%. Examples of hardwood fibers include, but are not limited to, a Southern hardwood mix and Northern hardwood mix from North America and Eucalyptus from Brazil.

In some examples, the paper core (110) may further comprise a filler, for example to substantially control some physical properties of the paper substrate. Particles of the filler fill in the void spaces of the fiber network and substantially result in one or more of a denser, smoother, and brighter paper substrate than without filler. Examples of fillers that may be incorporated into the fiber mixture of the paper core (110) include, but are not limited to, ground calcium carbonate, precipitated calcium carbonate, titanium dioxide, kaolin clay, silicates, plastic pigment, alumina trihydrate and combinations of any of the above. For example, inorganic filler, such as titanium dioxide, also may facilitate control of transparency or opacity of the paper core (110). In some examples, the paper core (110) comprises an amount by dry weight of filler ranging from about 0% to about 5% of the paper core composition. In some examples, the amount by weight of filler in the paper core (110) ranges from about 0% to about 4.5%, or about 0% to about 4%, or about 0% to about 3.5%, or about 0% to about 3%, or about 0% to about 2.5%, or about 0% to about 2%, or about 0% to about 1.5%, or about 0% to about 1%, or about 0% to about 0.5%. Examples of filler include, but are not limited to, Magfil from Specialty Minerals, Inc. of Bethlehem, Pa., USA or HYDROCARB® 60 calcium carbonate from Omya North America.

In some examples, internal sizing agents may be added to the paper core (110). Examples of internal sizing agents that may be used include, but are not limited to, one or more of metal salts of fatty acids, fatty acids, alkyl ketene dimer (AKD) emulsification products, epoxidized higher fatty acid amides, alkenyl acid anhydride emulsification products, alkylsuccinic acid anhydride (ASA) emulsification products, and rosin derivatives. Some examples of commercially available ASA and AKD include, but are not limited to, Nalco 7542 ASA from Nalco Company, IL, USA and AKD 2030 from BASF.

The image receiving layer (120) comprises an image receiving material composition capable of receiving and retaining an imaging material applied in a pattern (or image). For example, imaging materials including, but not limited to, an inkjet ink, a dry toner or a liquid toner that are applied using inkjet printing technology, dry electrophotography (DEP), or liquid electrophotography (LEP), respectively, for example, may be used with the image receiving layer (120). Moreover, the inkjet ink or toner may be water-based, solvent-based, or oil-based. In some examples, the image receiving layer (120) may provide relatively fast drying of inks or toners that are applied thereto.

In some examples, the image receiving layer (120) for inkjet imaging materials is a porous (e.g., microporous) layer comprising an image receiving composition that comprises one or more of a high porosity inorganic oxide dispersion, an inorganic pigment, an organic pigment, a binder and other additives. For example, the high-porosity, inorganic oxide dispersion includes any number of inorganic oxide groups including, but not limited to, a fumed silica or alumina treated with silane coupling agents containing functional groups. In another example, silica or silica gel may be used. Inorganic pigments include, but are not limited to, one or more of calcined clay, kaolin clay, ground calcium carbonate (GCC), precipitated calcium carbonate (PCC), silica, silica gel, and alumina. Binders include, but are not limited to, one or more of polyvinyl alcohol, polyvinyl acetates, polyacrylates, polymethyl acrylates, polystyrene-butadiene, polyethylene-polyvinylacetate copolymers, starch, casein, gelatin and mixtures and copolymers thereof, for example. Organic pigments include, but are not limited to, one or more of polystyrene, polymethyl acrylates or polyacrylates or copolymers thereof, for example. Other additives include, but are not limited to, colorants, optical brighteners, defoamers, wetting agents, rheology modifiers and other agents, for example. In some examples, the image receiving composition may include a number of components including, but not limited to, one or more of a cationic pigment, a binder, surfactants, plasticizers, and a binder cross-linker.

In some examples, the image receiving layer (120) composition comprises calcined clay as a first pigment material in an amount of about 25% to about 70% by dry weight of the image receiving composition. The calcined clay may be ANSILEX® 93 from Englehard Corp. of Iselin, N.J., USA or NEOGEN® 2000 from Imerys Pigments, Inc. of Roswell, Ga., USA, for example. Moreover in some of these examples, the image receiving material may comprise kaolin clay or PCC as a second pigment material in an amount of about 30% to about 60% by dry weight of the image receiving composition. For example, an ultrafine kaolin clay, such as MIRAGLOS® 91 from Englehard Corp. of Iselin, N.J., USA, or POLYGLOSS® 90 from J. M. Huber Corp. of Edison, N.J., USA may be used. In some examples, the image receiving composition further comprises a plastic pigment as a third pigment in an amount of about 1% to about 4% by dry weight of the image receiving composition. The plastic third pigment may be solid or hollow and includes such plastic pigments as 788A, 756A and 722HS from Dow Chemical, Midland, Mich., USA, for example.

In other examples, the image receiving material composition comprises silica, silica gel, or fumed silica that is treated with an inorganic treating agent and a monoamino-organosilane treating agent to form a cationic pigment. For example, the composition may comprise about 70% to about 100% dry weight of fumed silica. The fumed silica includes, but is not limited to, CAB-O-SIL® M-5 or CAB-O-SIL® MS-55 from Cabot; ORISIL™ 200, ORISIL™ 250 or ORISIL™ 300 from Orisil, Ltd., Ukraine; or AEROSIL® 200 or AEROSIL® 300 from Degussa (Evonik Industries). The composition may further comprise about 5% to about 15% dry weight of an organosilane treating agent. Examples of organosilane treating agents that may be used include, but are not limited to, Silquest® A-1100 gamma-aminopropyltriethoxysilane (registered trademark of Crompton Corp. or its subsidiaries) available from GE; or Dynasylan® (DS) 1189 N-(n-Butyl)-3-aminopropyl-trimethoxy-silane available from Degussa (Evonik Industries). The composition may further comprise about 1% to about 5% dry weight of an inorganic treating agent. An example of the inorganic treating agent that may be used includes, but is not limited to, an aluminum chlorohydrate (ACH) such as Locron® P from Clariant. The composition may further comprise about 0.1% to about 1% dry weight of a surfactant. An example of the surfactant that may be used includes, but is not limited to, SILWET® L-7600 organosilicone from GE. The composition may further comprise about 1% to about 5% dry weight of a binder cross-linker. An example of the binder cross-linker that may be used includes, but is not limited to, boric acid available from Aldrich Inc. The composition may further comprise about 15% to about 30% dry weight of a binder. The binder material includes, but is not limited to, one or more of polyvinyl alcohol, polyvinyl acetate, polyvinyl acrylate, polyvinyl acrylate esters, polyvinyl methacrylate, polyvinyl methacrylate esters, mixtures thereof, copolymers of monomer units thereof, and combinations thereof. An example of a water soluble binder that may be used includes, but is not limited to, polyvinyl alcohol (PVA) sold under the trade name MOWIOL® 40-88 or Poval 235 available from Kuraray America, Inc.

In other examples, the image receiving layer (120) for toner imaging materials comprises an image receiving composition that comprises one or more of inorganic pigments, discharge control agents, hollow particle pigments, organic binders, organic cross-linkable resins and other additives. The inorganic pigments include, but are not limited to, titanium dioxide, hydrated alumina, calcium carbonate, barium sulfate, silica, clays, such as kaolin clay, and zinc oxide, for example. The hollow particle pigment or plastic hollow pigment includes, but is not limited to, hollow particles that include one or more voids within an outer dimension of the particle volume, for example, styrene emulsion polymers. The discharge control agent is a composition that reduces defects caused electrostatic discharge that may occur in electrophotographic printing processes, for example. For example, ionic conductive polymers and polymeric electrolytes containing alkali metal salts may be used. In some examples, one or more of cationic, anionic, amphoteric, and nonionic polymer surfactant or polymer electrolytes may be used as the discharge control agent. Examples of water soluble polymer binders include, but are not limited to, polyvinyl alcohol, starch derivatives, gelatin, cellulose derivatives, and acrylamide polymers. Examples of water dispersible polymer binders include, but are not limited to, acrylic polymers or copolymers, vinyl acetate latex, polyesters, vinylidene chloride latex and styrene-butadiene or acrylonitrile-butadiene copolymer latex. Crosslinkable organic resins include, but are not limited to, cross-linkable styrene maleic anhydride (SMA), including its hydrolyzed acid and partial ester forms, or a cross-linkable polyurethane resin, for example.

The second material layer (130) of the graphic medium (100) is provided on one or both of the first side of the paper core (110) and a second side of the paper core (110) that is opposite to the first side. In some examples, the second material layer (130) is provided on the second side of the paper core (110), as illustrated in FIG. 1A, and is also referred to as the back coating or coating (130). The back coating (130) is a means for controlling one or more of opacity and curl (i.e., flatness), stiffness, and for protection of the graphic medium (100) from environmental elements. In some examples, the coating (130) comprises one or more of calcium carbonate, clay, and a water dispersible binder in a coating (130) composition. The water dispersible binder includes, but is not limited to, one or more of latex and a variety of styrene acrylate copolymers. In some examples, the coating (130) composition may further comprise one or more of a water soluble binder, an optical brightening agent (OBA) and a dye. Water soluble binders include, but are not limited to, one or more of alcohols, polyvinyl alcohol, and ethers. An example of an OBA is a tetrasulfonated stilbene compound commercially available under the designation TINOPAL® ABP-A from Ciba; and an example of a dye or colorant is IRGALITE® Blue Dye by Ciba.

For example, the coating (130) composition comprises calcium carbonate, for example HYDROCARB® 60 available from Omya, Inc., in an amount by weight within a range of about 40% to about 80% of the coating composition. The coating (130) composition further comprises clay, for example MIRAGLOSS® available from Engelhard Corporation, in an amount by weight within a range of about 20% to about 60% of the coating composition, for example. The coating (130) composition further comprises a water dispersible binder, such as a latex, for example ACRONAL® S 728 available from BASF, in an amount by weight within a range of about 5% to about 20% of the coating composition, for example. In some examples, the coating (130) composition further comprises a water soluble binder, such as polyvinyl alcohol, for example MOWIOL® 6-98 available from Kuraray America, Inc., in an amount by weight within a range of about 0% to about 1% of the coating composition. In some examples, the coating (130) composition may further comprise an OBA, e.g., TINOPAL® ABP-A, in an amount by weight within a range of about 0% to about 1% of the coating composition and a dye, for example IRGALITE® Blue Dye, in an amount by weight within a range of about 0% to about 0.01% of the coating composition, for example.

In some examples, the second material layer (130) of the graphic medium (100) comprises one or more barrier films. FIG. 1B illustrates another example of a graphic medium (100) in accordance with the principles described herein. In the example illustrated in FIG. 1B, the second material layer (130) comprises both a first barrier film (132) located between the paper core (110) and the image receiving layer (120) on the first side of the paper core (110) and a second barrier film (134) located on the second side of the paper core (110). In some examples (not illustrated), only one of the barrier films is included, which may be either the first barrier film on the first side or the second barrier film on the second side. In some of these examples, the first barrier film (132) is on the first side and the back coating (130), as described above, is on the second side. The barrier films are means for one or both of protection from environmental conditions and curl control (i.e., one or both of flatness and stiffness) of the graphic medium (100). In some examples, the barrier film provides means for facilitating adhesion/cohesion between layers.

In some examples, the barrier films (132, 134) comprise a plastic polymeric material including, but not limited to, polyethylene, polypropylene, and polyethylene teraphthalate, for example from Chevron Phillips Chemical Company or from Formosa Plastic Company. In other examples, the barrier films (132, 134) comprise a renewable polymeric material including, but not limited to, a starch, polylactic acid (PLA) from Cargill Dow Chemical Co. or from Cereplast, Inc., CA, for example, and a polyhydroxyalkanoate (PHA) and polyhydroxybutyrate (PHB) from Metabolix Company, MA, or Biocycle, Brazil. Using a renewable polymeric material as the barrier film (132, 134) facilitates recyclability of the graphic medium (100).

Figure 2:
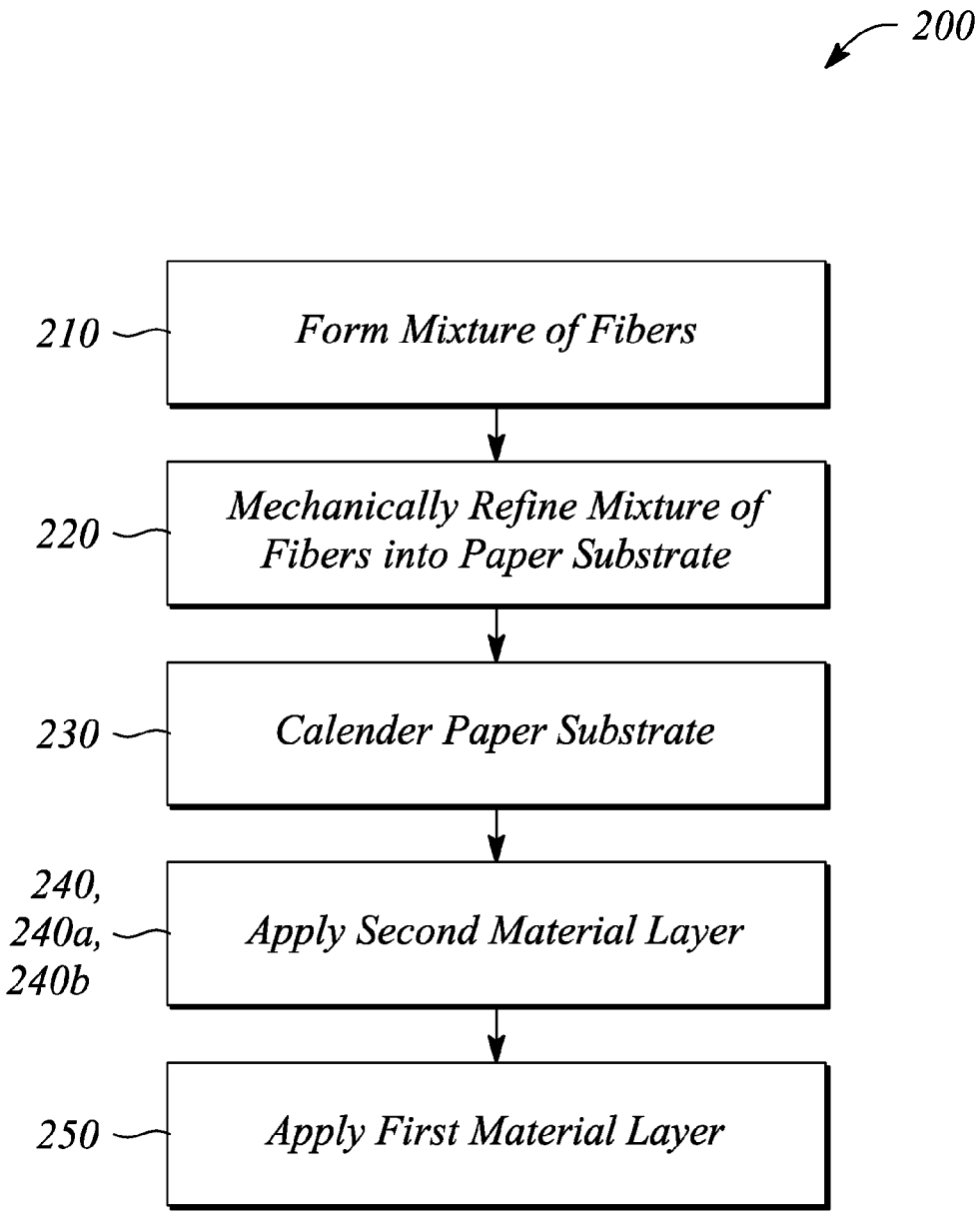
FIG. 2 illustrates a flow chart of a method of manufacturing a graphic medium having a paper core according to an example in accordance with the principles described herein.

FIG. 2 illustrates a flow chart of an example of a method (200) of manufacturing a graphic medium having a paper core in accordance with the principles described herein. The method (200) of manufacture comprises forming (210) a mixture of wood fibers, for example a pulp slurry. In some examples, the mixture of wood fibers comprises bleached softwood fibers in an amount that ranges from about 60% to about 100% by weight; bleached hardwood fibers in an amount by weight that ranges from about 0% to about 40%; and filler in an amount by weight that ranges from about 0% to about 5%, or as further described herein. The wood fiber materials and the filler include those described above for the paper core (110) of the graphic medium (100), for example.

The method (200) of manufacturing a graphic medium further comprises mechanically refining (220) the wood fibers of the mixture, and using the mechanically refined wood fiber mixture in a paper making machine to form a paper substrate. The fibers of the mixture are hollow conducting tubes. The mechanical refining (220) collapses the fibers into flat ribbons to increase contact surface area of fibers, to make the fibers more flexible, and to create a dense fiber-to-fiber structure by substantially eliminating air pockets between fibers. The increased contact surface area and flexibility provide for increased bonding between fibers and tends to densify the fiber-to-fiber structure that forms the paper substrate. Removal of air pockets and increasing the density of the structure increases the transparency of the formed paper substrate. In particular, the mechanical refining (220) is used to control the opacity of the formed paper substrate; and the level of mechanical refining (220) is adjusted to reach a targeted opacity and stiffness of the paper substrate. In some examples, the fiber mixture is mechanically refined (220) until the formed paper substrate has a normalized opacity within a range of about 0.15%/gsm to about 0.4%/gsm. Moreover, the formed paper substrate has a higher relative bonded area and is a highly dense structure. In some examples, the paper substrate is substantially the same as the paper core (110) described above for the graphic medium (100).

The mechanical refining (220) comprises intense mechanical action to collapse the fibers of the mixture and one or more of fibrillate an inside of the fibers, fibrillate an outside of the fibers, shorten the fibers and generate fine (e.g., small fiber segments of less than about 1 mm in length), for example. External fibrillation substantially removes one or both of a primary wall and an S1 layer and substantially raises fibrils on an S2 layer to expose more surface area. Internal fibrillation substantially causes voids, increases fiber flexibility and hydrogen bonding. Fiber shortening or cutting substantially decreases the average length of the fibers. Fine generation is a combination of external fibrillation and fiber cutting, for example. Each of these actions on the fibers may produce effects on the formed paper substrate. For example, external fibrillation may increase surface area and provide a higher water holding capacity of the formed paper. Internal fibrillation may increase the strength of the paper, for example. In another example, fiber shortening or cutting may slow drainage and reduce tear strength of the paper. Fine generation may help in bonding and increase the strength of the paper, for example.

The intense mechanical action of the mechanical refining (220) comprises passing the mixture of fibers (e.g., a pulp slurry) between rotating plates covered with bars or blades. Shearing action between the plates causes the fibers to flex and release. After many cycles through the rotating plates, the fibers collapse into the flat ribbons. Controlling the number of cycles of the mechanical refining (220) manipulates and controls the opacity property of the formed paper. In some examples, a mechanical refiner, for example a continuous refiner, may be used including, but not limited to, disc refiners and conical refiners.

A disc refiner includes two or more plates or discs having blades, one of which may be stationary or all of which may move relative to the others. The disc refiner may be categorized by the number of sets of discs, for example, single, double or triple disc refiners. The plane of action is typically perpendicular to the axis of rotation. For example, a single disc refiner may include a rotating bladed disc that moves in conjunction with a stationary bladed disc. In another example, the single disc refiner may include a sliding disc and a rotary disc, one or both of which has blades. Disc refiners are manufactured by Beloit Corp., WI, USA or Andritz Sprout, Pa., USA, for example.

A conical refiner includes a fixed or stationery conical shell or stator and a rotating conical plug or rotor. Each of the stator and rotor are fitted with bars or blades oriented lengthwise or axially on their surface to provide opposing sets of bars to treat fibers. The conical plug rotates on a horizontal axis within the shell and fibers flow parallel to the bars. Conical refiners may be categorized by, for example, low angle or Jordan type, and high angle or Claflin type. Conical refiners are manufactured by Bolton Emerson Americas, Inc., MA, USA, for example.

The method (200) of manufacturing a graphic medium having a paper core further comprises calendering (230) the formed paper substrate in a calender section of the paper making machine. The calender section comprises a plurality of rollers that apply pressure and heat to the formed paper substrate from two sides. Calendering (230) smoothes the paper substrate and gives the paper substrate a substantially uniform thickness, for example. The finish of the paper substrate is controlled with the pressure applied by the calendering rollers, such that calendering (230) also may provide a level of gloss to the paper substrate, for example.

In some examples, the paper substrate made by the method (200) herein has a basis weight within a range of about 100 gsm to about 300 gsm, as determined using TAPPI test method T410. In some examples, the basis weight is within the range of about 100 gsm to about 275 gsm, or about 100 gsm to about 250 gsm, or about 100 gsm to about 225 gsm, or about 100 gsm to about 200 gsm. In some examples, the basis weight is within the range of about 110 gsm to about 300 gsm, or about 120 gsm to about 300 gsm, or about 130 gsm to about 300 gsm, or about 140 gsm to about 300 gsm, or about 150 gsm to about 300 gsm, or about 160 gsm to about 300 gsm, or about 170 gsm to about 300 gsm, or about 180 gsm to about 300 gsm, or about 190 gsm to about 300 gsm, or about 200 gsm to about 300 gsm, or about 250 gsm to about 300 gsm. In some examples, basis weight in grams per square meter is approximately equivalent to thickness in microns, for example 1 gsm approximately equals 1 micron.

In some examples, the paper substrate having a basis weight within the range of about 100 gsm to about 300 gsm also has a relatively transparent opacity value within a range of about 20% to about 70%. In some examples, the relatively transparent opacity of the paper substrate is within the range of about 20% to about 65%, or about 20% to about 60%, or about 20% to about 55%, or about 20% to about 50%, or about 20% to about 45%, or about 20% to about 40%, or about 20% to about 35%, or about 20% to about 30%. In some examples, the opacity of the paper substrate is within the range of about 22% to about 70%, or about 24% to about 70%, or about 26% to about 70%, or about 28% to about 70%, or about 30% to about 70%, or about 25% to about 65%, or about 25% to about 60%, or about 30% to about 60%.

In some examples, the normalized opacity of the paper substrate made by the method (200) herein is within the range of about 0.15%/gsm to about 0.4%/gsm, as provided above. In some examples, the normalized opacity of the paper substrate is within the range of about 0.17%/gsm to about 0.4%/gsm, or about 0.19%/gsm to about 0.4%/gsm, or about 0.2%/gsm to about 0.4%/gsm, or about 0.22%/gsm to about 0.4%/gsm, or about 0.25%/gsm to about 0.4%/gsm, or about 0.27%/gsm to about 0.4%/gsm, or about 0.3%/gsm to about 0.4%/gsm, or about 0.32%/gsm to about 0.4%/gsm, or about 0.35%/gsm to about 0.4%/gsm, or about 0.37%/gsm to about 0.4%/gsm. In some examples, the normalized opacity of the paper substrate is within the range of about 0.15%/gsm and about 0.38%/gsm, or about 0.15%/gsm and about 0.36%/gsm, or about 0.15%/gsm and about 0.34%/gsm, or about 0.15%/gsm and about 0.33%/gsm, or about 0.15%/gsm and about 0.3%/gsm, or about 0.15%/gsm and about 0.28%/gsm, or about 0.15%/gsm and about 0.26%/gsm, or about 0.15%/gsm and about 0.24%/gsm, or about 0.15%/gsm and about 0.22%/gsm, or about 0.15%/gsm and about 0.2%/gsm. In an example, the normalized opacity of the paper substrate is within the range of about 0.2%/gsm and about 0.25%/gsm.

Figure 3:
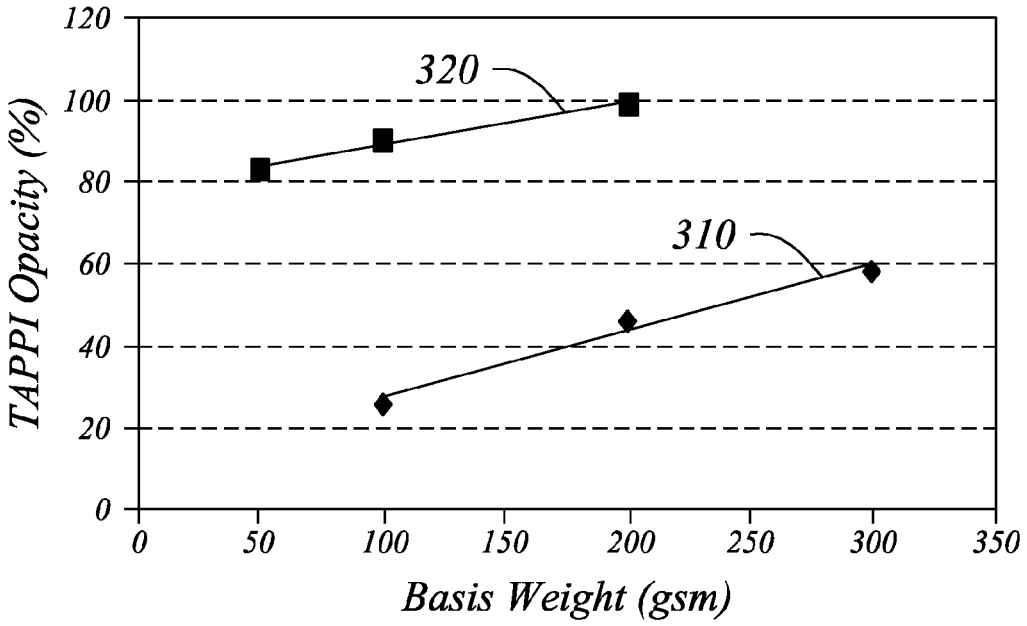
FIG. 3 illustrates a graph of opacity with respect to basis weight for a paper substrate according to an example in accordance with the principles described herein plotted relative to a reference paper sample.

FIG. 3 illustrates a graph of opacity with respect to basis weight for the paper substrate made by the method (200) herein according to an example in accordance with the principles described herein plotted relative to a reference paper sample. As illustrated in FIG. 3, the opacity is proportional to the basis weight and has a substantially linear relationship to the basis weight. The opacity (310) of the relatively transparent paper substrate is substantially lower than the opacity (320) of the reference paper sample for the same basis weight. The reference paper sample includes any one of HP Office paper (having about 80 gsm basis weight), HP Color Laserjet paper (having about 200 gsm basis weight), HP Universal bond paper (having about 80 gsm basis weight), and Hammermill Color Copy Cover paper (having about 220 gsm basis weight), by way of example.

In some examples, the paper substrate made by the method (200) herein has a density that is equal to or greater than 1.1 grams per cubic centimeter ($g/cm^3$), as calculated by dividing caliper by basis weight. In some examples, the density of the paper substrate is equal to or greater than about 1.15 $g/cm^3$, or equal to or greater than about 1.2 $g/cm^3$, or equal to or greater than about 1.25 $g/cm^3$, or equal to or greater than about 1.3 $g/cm^3$, or equal to or greater than about 1.35 $g/cm^3$, or equal to or greater than about 1.4 $g/cm^3$, or equal to or greater than about 1.45 $g/cm^3$, or equal to or greater than about 1.5 $g/cm^3$.

Moreover, a porosity of the paper substrate is less than or equal to about 0.5 milliliters per minute (ml/min), for example, as measured using PPS 78 Park Print Surf (PPS) microprocessor-controlled instrument from Testing Machine Inc. (TMI) that performs high speed, precision measurements of paper porosity. In some examples, the porosity of the paper substrate has a value within a range of from 0 to about 0.5 ml/min, or 0 to about 0.45 ml/min, or 0 to about 0.4 ml/min, or 0 to about 0.35 ml/min, or 0 to about 0.3 ml/min, or 0 to about 0.25 ml/min, or 0 to about 0.2 ml/min, or about 0 to about 0.15 ml/min. In some examples, the porosity of the paper substrate is within the range of about 0.001 ml/min to about 0.01 ml/min, or about 0.001 ml/min to about 0.1 ml/min, or about 0.001 ml/min to about 0.15 ml/min, or about 0.01 ml/min to about 0.1 ml/min, or about 0.01 ml/min to about 0.15 ml/min.

The method (200) of manufacturing a graphic medium having a paper core further comprises applying (240) a second material layer to one or both of a first side of the paper substrate and a second side of the paper substrate that is opposite to the first side, and applying (250) an image receiving layer to the first side of the paper substrate. In some examples, the second material layer is the same as the second material layer (130) described above for the graphic medium (100). In some examples, the second material layer is a 'back coating' applied to an opposite side of the paper substrate from the side with the image receiving layer applied thereto. In some examples, the back coating is the same as the back coating (130) described above for the graphic medium (100). In some examples, the second material layer is a 'barrier film' applied to one or both of the first and second sides of the paper substrate. The barrier film on the first side is sandwiched between the image receiving layer and the paper substrate. In some examples, the barrier film is the same as the barrier films (132, 134) described above for the graphic medium (100). In some examples, the image receiving layer is the same as the image receiving layer (120) described above for the graphic medium (100).

In some examples, applying (240) a second material layer comprises applying (240*a*) a back coating to the second side of the paper substrate. The back coating is applied (240*a*) using coating techniques including, but not limited to, one or more of rod, roll, blade, curtain, slide or slot die and film press coating, for example. In some examples, applying (240) a second material layer comprises applying (240*b*) a barrier film to one or both of the first side and the second side of the paper substrate. The barrier film is applied (240*b*) using coating techniques including, but not limited to, one or more of a hot melt extrusion process, a hot film lamination process, and a cold film lamination process.

In some examples, the second material layer, whether the coating or a barrier film, is applied (240*a*, 240*b*) to the second side of the paper substrate and the image receiving layer is applied (250) to the first side of the paper substrate to create a graphic medium with a paper core, as illustrated in FIG. 1A, for example. In some examples, the second material layer is the barrier film applied (240*b*) to both the first side and the second side of the paper substrate, and the image receiving layer is applied (250) to the first side over the applied barrier film on the first side to create a graphic medium with a paper core, as illustrated in FIG. 1B, for example. In some examples, the second material layer comprises the coating applied (240*a*) to the second side and the barrier film applied (240*b*) to the first side of the paper substrate, and then the image receiving layer is applied (250) to the first side on the applied barrier film to create a graphic medium with a paper core. FIG. 1B may be considered illustrative of this example as well. In some examples, the second material layer is a barrier film applied (240*b*) to just the second side and the image receiving layer is applied (250) to the first side to create a graphic medium with a paper core. FIG. 1A may be considered illustrative of this example as well.

In some examples, the image receiving layer may be applied (250) to the paper substrate as an aqueous coating or suspension, and then dried. For example, the image receiving layer is applied (250) to the paper substrate using coating techniques including, but not limited to, slotted die application, roller application, fountain curtain application, blade application, rod application, air knife application, gravure application, and air brush application. The applied image receiving layer is dried by convection, conduction, infra-red radiation, atmospheric exposure, or a combination of one or more of these, for example. In some examples, calendering (230) the paper substrate comprises one or both of applying (240*a*) the back coating and applying (250) the image receiving layer. In some examples, the graphic medium made by the method (200) herein is the same as the graphic medium (100) described above.

In some examples, each of the second material layers and the image receiving layer independently have a dried basis weight on the paper substrate within a range of about 5 gsm to about 30 gsm. In some examples, the dried basis weight of each of the respective layers is independently within the range of about 5 gsm to about 25 gsm, or about 5 gsm to about 23 gsm, or about 5 gsm to about 20 gsm, or about 5 gsm to about 17 gsm, or about 5 gsm to about 15 gsm, or about 5 gsm to about 13 gsm, or about 5 gsm to about 10 gsm. In some examples, the range of dried basis weight of each of the respective layers is independently about 7 gsm to about 25 gsm, or about 7 gsm to about 20 gsm, or about 10 gsm to about 20 gsm, or about 12 gsm to about 20 gsm, or about 15 gsm to about 20 gsm. For example, the basis weight of the back coating or barrier film may be about 5 gsm and the basis weight of the image receiving layer may be about 10 gsm or 20 gsm. In another example, the basis weight of the back coating or barrier film may be about 15 gsm and the basis weight of the image receiving layer may range from about 7 gsm to about 15 gsm. In another example, the basis weight of the back coating or barrier film and the basis weight of the image receiving layer may each be about 20 gsm. In some examples, the image receiving layer has a microporous surface, while in other examples, the surface of the image receiving layer is swellable, which depends on the image receiving materials used, as described herein with respect to the image receiving layer (120) of the graphic medium (100), for example.

In some examples, the basis weight of each of the second material layer(s) and the image receiving layer is independently between 10 times and 20 times less than the basis weight of the paper substrate or core, for example. In some examples, the basis weight of each of the second material layer(s) and the image receiving layer is independently between 10 times and 18 times less, or between 10 times and 16 times less, or between 10 and 14 times less, or between 10 and 12 times less than the basis weight of the paper substrate or core.

In some examples, the graphic medium (100) with a paper core in accordance with the principles described herein has a translucent opacity within a range of about 40% to about 90%. In some examples, the range of opacity of the graphic medium is between about 40% and about 85%, or between about 40% and about 80%, or between about 40% and about 75%, or between about 40% and about 70%, or between about 40% and about 65%, or between about 40% and about 60%, or between about 40% and about 55%, or between about 40% and about 50%. In some examples, opacity of the graphic medium with a paper core is within a range of about 45% to about 90%, or about 47% to about 87%, or about 49% to about 87%.

In some examples, the graphic medium (100) with a paper core in accordance with the principles described herein may be used to prepare a poster or signage using either inkjet printing technology, LEP printing or DEP printing to create a printed image on the image receiving layer of the graphic medium. In some examples, the opacity of the graphic medium (100) provides for the graphic medium to be illuminated, such as with back lighting or front lighting, to create a backlit or frontlit display or sign useable day or night. For example, the illuminated display or sign may be used indoors or outdoors, such as at bus stops, airports, bus terminals, train terminals, museums, libraries, schools, banks, and other businesses. As mentioned above, the graphic medium (100) has one or more of the following properties: recyclable, renewable, durable, available in wide ranges of opacity and stiffness, easily manufactured, and low cost.

EXAMPLES

All measured values are within measurement tolerance for the equipment used, unless otherwise indicated.

Transparent Paper Core Example:

A transparent paper prototype was prepared using pure bleached softwood pulp fibers. The prototype was mechanically treated by refining and supercalendering to achieve a targeted density (>1 g/cm$^3$) and transparency level (<80%). The refining was performed using a laboratory valley beater (per TAPPI Test Method T200). Hand sheets were made using a British hand sheet former (per TAPPI Method T205). Calendering was performed using an offline single nip supercalender at 3200 psi pressure and 48.9° C. temperature to achieve final density (>1 g/cm3) and opacity (<80%). Physical properties of the transparent paper prototype was compared to several commercially available office papers from Hewlett-Packard (HP), USA, and a commercially available transparent paper, ZANDERS Spectral base, from M-real Zanders GmbH, Germany. Table 1 illustrates basis weight, density and opacity characteristics of the transparent paper prototype, the transparent Spectral base, and the controls for comparison.

TABLE 1

A transparent paper prototype compared to several commercially available papers.

| | Sample ID | | | | |
|---|---|---|---|---|---|
| | Control | | | Transparent Paper | |
| | Plain Paper | Color Laser | Cover Paper | Proto-type | Spectral base |
| Basis Wt (gsm) | 50 | 100 | 200 | 160 | 189 |
| Opacity (%) | 83 | 94 | 99 | 60 | 34 |
| Density (g/cm$^3$) | 0.75 | 0.80 | 0.94 | 1.11 | 1.26 |
| Normalized Opacity %/gsm) | 1.66 | 0.94 | 0.50 | 0.38 | 0.18 |

Image Receiving Layer (IRL) Example:

An image receiving material composition was prepared. For a first IRL sample A configured for receiving an inkjet ink imaging material: a silica dispersion was prepared by adding de-ionized water to a dispersion tank, then adding 2.65 parts Locron® P aluminum chlorohydrate (ACH) from Clariant and 8 parts DS 1189 organosilane from Degussa (Evonik Industries), and mixing for 20 minutes. Then, 88.3 parts CAB-O-SIL® MS-55 fumed silica from Cabot was added and dispersing was started using a high shear Rotor-Stator mixing head ystral-TDS3 or 4 from Ystral GmbH, Germany, for at least 60 minutes. Separately, a water soluble binder was prepared by adding de-ionized water and 20 parts Poval 235 polyvinyl alcohol (PVA) from Kuraray America, Inc. into a PVA cooker and heated to 90° C. for 40 minutes. The silica dispersion was mixed with 0.5 part of surfactant SILWET® L-7600 from GE and 2.5 parts boric acid from Aldrich Inc. in a mixing vessel for 30 minutes. The cooked PVA binder was added to the mixture in the mixing vessel and mixed for 40 minutes.

Second Material Layer (SML) Examples:

SML sample I (i.e., a 'back coating' or 'curl control coating') was prepared. A mixing vessel was charged with water and 60 parts of OPACARB® A40 calcium carbonate from Specialty Minerals, Inc. of Bethlehem, Pa. was added to the mixing vessel and stirred for 5 minutes. Then, 0.5 parts of Tego® Wet 510 non-ionic organic surfactant from Evonik Tego Chemie GmbH, Germany, was added to the mixing vessel and the mixture was stirred for 5 minutes. Then, 40 parts of ANSILEX 93 calcined clay from Englehard Corp. was added to the mixing vessel and the mixture was stirred for 10 minutes. Then, 11 parts of Litex 7110 latex (an aqueous, anionic carboxylated styrene/butadiene copolymer dispersion) from PolymerLatex GmbH, Germany, was added to the mixing vessel and the mixture was mixed for 10 minutes. Separately, a water soluble binder was prepared by adding de-ionized water and 1 part of MOWIOL® 20-98 PVA from Kuraray America, Inc. into a PVA cooker and heated to 95° C. for 20 minutes. The cooked PVA was added to the mixture in the mixing vessel and mixed for 15 minutes.

For both SML sample II (a first barrier film) and SML sample III (a second barrier film), a low density polyethylene (LDPE), Chevron 1017, from Chevron Phillips Chemical Company was used.

Graphic Medium Examples:

Graphic medium (GM) samples were prepared. Three graphic medium samples (GM 1, 2, 3) were prepared using the above-described ZANDERS Spectral base transparent paper as the transparent paper core.

For GM samples 1 and 2, the IRL A was applied to a first side of the Spectral base transparent paper core using a pilot curtain coater at 50 meters per minute (mpm), and dried using a non-contact air floatation dryer at 90° C. to an exit moisture content of 4.5%. Moreover, for GM samples 1 and 2, the SML I back coating (i.e., curl control coating) was applied to the second side of the Spectral base transparent paper core using the pilot curtain coater at 150 mpm, and dried at 110° C. with the non-contact air floatation dryer.

For GM sample 3, the SML II and III (i.e., first and second barrier film layers) were extrusion coated on opposite sides of the Spectral base transparent paper core using a screw type pilot extruder at meting temperature 300° C. Then IRL A was subsequently coated on the SML II barrier film using the technique described above for applying the IRL A to GM samples 1 and 2.

Control Samples:

A graphic medium control sample, GM Control, was HP Premium Vivid Backlit Color Film, an off-the-shelf, commercially available graphic medium comprising a PET film core and an image receiving layer. Moreover, the ZANDERS Spectral base is provided as a Transparent Paper Control, and a 0.1905 mm thick Skyrol® polyester film from SKC, Inc., Georgia, USA, is provided as a PET film Control, as comparisons.

ink and the image quality of the printed images was evaluated. Table 3 identifies the inkjet printers used to print images on the different samples. In particular, a variety of inkjet printers and compatible inkjet inks manufactured by Hewlett-Packard Co., CA, USA, were used. For example, HP Z3100 pigmented based ink and HP Designjet HP Z3100 series Photo Printer were used to evaluate image quality on GM 1 and 2 and the GM Control. HP Z6100 pigmented based ink and HP Designjet HP Z6100 series Photo Printer were used to evaluate image quality on GM 3 and the GM Control. HP 5500 UV Designjet pigmented based ink and HP Designjet HP5500 UV Printer were used to evaluate image quality on GM 1, 2 and 3 and the GM Control. In addition, HP D7360 dye based ink and HP Photosmart D7360 Printer were also used to evaluate image quality on GM 1, 2 and 3 and the GM Control. HP 5000 dye based ink and HP Designjet HP 5000 series Printer were used to evaluate image quality on GM 3 and the GM Control. In addition, HP 25500 latex based ink and HP Designjet HP L25500 series Printer were also used to evaluate image quality on GM 3 and the GM Control.

TABLE 2

Composition and physical properties of graphic medium (GM) samples and Controls. Basis or coat weights of IRL and SML were target values.

| | SAMPLE (GM = Graphic Medium) | | | | | |
|---|---|---|---|---|---|---|
| | GM 1 | GM 2 | GM 3 | GM Control | Transparent Paper Control | PET Film Control |
| Core Type | Transparent Paper | | | PET Film | Transparent Paper | PET Film |
| Image Receiving Layer (IRL) | A | A | A | | — | — |
| IRL A Basis Weight (gsm) | 10 | 20 | 24 | | — | — |
| Second Material Layer (SML) - Second side | I | I | III | | — | — |
| SML (Second side) Basis or Coat Weight (gsm) | 15 | 20 | 25 | | — | — |
| Second Material Layer (SML) - First side | — | — | II | | — | — |
| SML II (First side) Coat Weight (gsm) | — | — | 20 | | — | — |
| Total Basis Weight (gsm) | 221 | 235 | 260 | 273 | 189 | — |
| Physical Properties | | | | | | |
| Caliper (μm) | 173 | 190 | 220 | 217 | 150 | 152 |
| Density (g/cm$^3$) | 1.28 | 1.24 | 1.18 | 1.26 | 1.26 | |
| Opacity (%) | 78.6 | 86.3 | 78.3 | 78.3 | 33.7 | 7.8 |

Table 2 provides a listing of the three graphic medium (GM) samples made as described above and properties of the GM samples as compared to the GM Control sample described above, and the Transparent Paper and the PET film Controls described above. The physical properties listed in Table 2 were obtained using various methods, for example TAPPI methods. In particular, caliper was determined using TAPPI method T411; opacity was determined using TAPPI method T425; and the basis weights were determined using TAPPI method T410. Density was calculated from a ratio of caliper to basis weight.

The graphic medium samples GM 1-3 from Table 2 and the PET-based graphic media control sample were printed with Table 3 summarizes results of a variety of image quality tests run on the samples GM 1-3 and the PET-based graphic medium control from Table 2. The image quality tests included evaluation of standard optical density (OD), bleed, green coalescence and color gamut tests for ink colors of black, magenta, yellow and cyan using each of the above-mentioned inkjet printers and inks After printing, the image quality of the prints, bleed, and coalescence was evaluated visually. Black point (L*min) and black optical density (KOD) were measured using a transmission/reflection densitometer, supplied by X-rite, Green Rapids, Mich. The Color Gamut volume was calculated based on X-Rite transmission/reflection densitometer measurements of L*, a*, and b* from 8 color patches (100% cyan, 100% magenta, 100% yellow, 100% red, 100% green, 100% blue, white and 100% black). The higher the values in each category in Table 3, the better the performance of the respective sample.

TABLE 3

Image quality comparisons between graphic medium samples and control.

| Image Quality | | GM 1 Translucent Paper Core | GM 2 Translucent Paper Core | GM 3 Translucent Paper Core | GM Control PET Film Core |
|---|---|---|---|---|---|
| HP Z3100 | Color Gamut | 1265 | 1460 | | 869 |
| | OD black | 1.67 | 1.76 | | 1.45 |
| | Bleed | 2 | 2 | | 2 |
| | Coalescence | 2 | 2 | | 2 |
| HP Z6100 | Color Gamut | | | 1473 | 564 |
| | OD black | | | 2.44 | 1.23 |
| | Bleed | | | 3 | 2 |
| | Coalescence | | | 4 | 2 |
| HP5500 UV | Color Gamut | 1300 | 1510 | 1640 | 673 |
| | OD black | 1.89 | 2.04 | 2.27 | 1.38 |
| | Bleed | 5 | 2 | 2 | 2 |
| | Coalescence | 4 | 2 | 2 | 2 |
| HP 7360 | Color Gamut | 1281 | 1356 | 1314 | 694 |
| | OD black | 2.31 | 2.26 | 2.22 | 1.4 |
| | Bleed | 2 | 2 | 2 | 2 |
| | Coalescence | 2 | 2 | 2 | 2 |
| HP5000 Dye | Color Gamut | | | 1436 | 771 |
| | OD black | | | 2.09 | 1.46 |
| | Bleed | | | 3 | 2 |
| | Coalescence | | | 2 | 2 |
| Latex HP L25500 | Color Gamut | | | 985 | 677 |
| | OD black | | | 1.58 | 1.37 |
| | Bleed | | | 2 | 2 |
| | Coalescence | | | 2 | 2 |

Thus, there have been described examples of a graphic medium and a method of making a graphic medium that both employ a relatively transparent paper core having a normalized opacity of about 0.15% to about 0.4% (TAPPI opacity) per gsm (basis weight). It should be understood that the above-described examples are merely illustrative of some of the many specific examples that represent the principles of what is claimed. Clearly, those skilled in the art can readily devise numerous other arrangements without departing from the scope defined by the following claims.

What is claimed is:

1. A graphic medium comprising:

a paper core having a normalized opacity within a range of about 0.15 to about less than 0.4 percent (%)/grams per square meter (gsm) and a density of greater than or equal to 1.1 grams per cubic centimeter (g/cm$^3$);

a first material layer on a first side of the paper core, the first material layer comprising a composition to both receive and retain an image pattern of an imaging material selected from the group consisting of an inkjet ink and a toner; and a second material layer on one or both of the first side of the paper core between the paper core and the first material layer and a second side of the paper core that is opposite to the first material layer, wherein the graphic medium has a translucent opacity within a range of about 40% to less than 80%.

2. The graphic medium of claim 1, wherein the second material layer is on both the first side and the second side of the paper core and comprises a material that facilitates one or more of opacity control, curl control, stiffness control and environmental protection to the graphic medium.

3. The graphic medium of claim 1, wherein the second material layer is only on the second side and comprises a material that facilitates one or more of opacity control, curl control, stiffness control and environmental protection to the graphic medium.

4. The graphic medium of claim 1, wherein the first material layer is receptive to an inkjet ink, the first material layer composition comprising either a high porosity inorganic oxide dispersion having an inorganic oxide group selected from the group consisting of silica, silica gel, and fumed silica or fumed alumina treated with a silane coupling agent, or a cationic pigment selected from the group consisting of silica, silica gel and fumed silica treated with an inorganic treating agent and a monoamino-organosilane treating agent.

5. The graphic medium of claim 1, wherein the paper core has an opacity within a range of about 25% and about 70% and a basis weight within a range of about 100 gsm and about 300 gsm.

6. The graphic medium of claim 1, wherein the paper core comprises wood-based cellulose fibers selected from the group consisting of bleached kraft pulp fibers and bleached sulfite pulp fibers.

7. The graphic medium of claim 1, wherein the paper core has one or more of a density of greater than or equal to 1.2 g/cm$^3$, a normalized opacity within a ran of 0.15 to 0.38%/gsm, a porosity less than or equal to about 0.5 milliliters per minute (ml/min), and a basis weight between about 100 and about 300 gsm.

8. The graphic medium of claim 1, wherein the second material layer comprises a macromolecular organic material selected from the group consisting of starch, poly(lactic acid) and a polyhydroxyalkanoate.

9. The graphic medium of claim 1, wherein the second material layer comprises a pigment selected from one or more of clay and calcium carbonate.

10. The graphic medium of claim 1 used in a front-lightable display or a back-lightable display that is one or more of recyclable, biodegradable and renewable.

11. The graphic medium of claim 1, wherein the density of the paper core is greater than 1.2 g/cm$^3$.

12. The graphic medium of claim 1, wherein the normalized opacity of the paper core is within the range of 0.15 to 0.38%/gsm, the translucent opacity of the graphic medium being within the range of about 40% to less than 79%.

13. A graphic medium comprising:

a paper core comprising bleached softwood fibers, the paper core having a normalized opacity within a range of about 0.15 to less than 0.4 percent/grams per square meter and a density greater than or equal to 1.1 grams per cubic centimeter;

an image receiving layer on a first side of the paper core; and a coating on a second side of the paper core opposite to the first side, the coating comprising a non-plastic, renewable polymeric material, a basis weight of either the image receiving layer or the coating being between about ten times and about twenty times less than a basis weight of the paper core, the graphic medium being translucent and having an opacity that is less than 79%.

14. The graphic medium of claim 13, wherein the normalized opacity of the paper core is within the range of 0.15 to 0.38%/gsm, the density of the paper core being greater than 1.2 g/cm$^3$.

15. A method of manufacturing a graphic medium with a paper core, the method comprising:

forming a mixture of wood fibers;

mechanically refining the fibers of the mixture until a paper substrate is formed having a normalized opacity ranging from about 0.15 to less than 0.4 percent/grams per square meter (%/gsm) and a density greater than or equal to 1.1 grams per cubic centimeter ($g/cm^3$);

calendering the paper substrate using a paper making machine;

applying a second material layer to one or both of a first side of the paper substrate and a second side of the paper substrate that is opposite to the first side; and applying a first material layer to the first side of the paper substrate to form the graphic medium with a paper core, the graphic medium having a translucent opacity within a range of about 40% to less than 80%, the first material layer comprising a composition to both receive and retain an image pattern of an imaging material selected from the group consisting of an inkjet ink and a toner.

16. The method of claim 15, wherein the mixture of wood fibers comprises bleached softwood fibers in an amount by weight of about 60% to about 100%; bleached hardwood fibers in an amount by weight of about 0% to about 40%; and filler in an amount by weight of about 0% to about 5%.

17. The method of claim 15, wherein the paper substrate has one or more of a porosity of less than about 0.5 milliliters per minute (ml/min), a normalized opacity within a range of 0.15 to 0.38%/gsm and a density greater than or equal to 1.2 $g/cm^3$.

18. The method of claim 15, wherein a basis weight of the first material layer or the second material layer is between about ten and about twenty times less than the basis weight of the paper substrate.

19. The method of claim 15, wherein the density of the paper substrate is greater than 1.2 $g/cm^3$.

20. The method of claim 15, wherein the normalized opacity of the paper substrate is within the range of 0.15 to 0.38%/gsm, the translucent opacity of the graphic medium being within the range of about 40% to less than 79%.

* * * * *

UNITED STATES PATENT AND TRADEMARK OFFICE

CERTIFICATE OF CORRECTION

PATENT NO. : 8,916,243 B2
APPLICATION NO. : 13/982259
DATED : December 23, 2014
INVENTOR(S) : Xulong Fu et al.

It is certified that error appears in the above-identified patent and that said Letters Patent is hereby corrected as shown below:

In the Claims

In column 17, line 47, in Claim 1, delete “about less” and insert -- less --, therefor.

In column 18, line 23, in Claim 7, delete “ran” and insert -- range --, therefor.

In column 20, line 6, in Claim 17, delete “gsm” and insert -- gsm, --, therefor.

Signed and Sealed this
Nineteenth Day of May, 2015

Michelle K. Lee

Michelle K. Lee
*Director of the United States Patent and Trademark Office*